US008088049B2

(12) United States Patent
Paris

(10) Patent No.: US 8,088,049 B2
(45) Date of Patent: Jan. 3, 2012

(54) EXERCISE DEVICE

(76) Inventor: Win Paris, Seal Beach, CA (US)

( * ) Notice: Subject to any disclaimer, the term of this patent is extended or adjusted under 35 U.S.C. 154(b) by 0 days.

(21) Appl. No.: 12/425,102

(22) Filed: Apr. 16, 2009

(65) Prior Publication Data

US 2010/0267528 A1 Oct. 21, 2010

(51) Int. Cl.
*A63B 21/008* (2006.01)
*A63B 23/16* (2006.01)

(52) U.S. Cl. ..... 482/112; 482/44

(58) Field of Classification Search ..... 482/111–113, 482/114–118, 44–50
See application file for complete search history.

(56) References Cited

U.S. PATENT DOCUMENTS 4,203,591 A * 5/1980 Gibson ..... 482/46
4,557,479 A * 12/1985 Guibert ..... 482/110
5,445,581 A * 8/1995 Ferber ..... 482/46
5,536,223 A * 7/1996 Ferber ..... 482/46
5,788,617 A * 8/1998 Paris ..... 482/112
5,820,521 A * 10/1998 Edwards et al. ..... 482/44
6,561,959 B2 * 5/2003 Batiste ..... 482/126

* cited by examiner

*Primary Examiner* — Fenn Mathew
(74) *Attorney, Agent, or Firm* — Murphy & King, P.C.

(57) ABSTRACT

An exercise device has two reciprocating arms, each provided with pneumatic or other fluid resistance. The angular orientation of the two arms is limited to one of 0, 45, 90, and 180 degrees. Adjustments are made by loosening a complementary fastener, moving the arms to the desired angular orientation, and then tightening the complementary fastener. Mating projections and recesses prevent movement of the arms relative to each other once the angular position is set.

17 Claims, 5 Drawing Sheets

EXERCISE DEVICE

FIELD OF THE INVENTION

The present invention relates to portable exercise devices, and more specifically, to devices for exercising muscles of the upper torso.

BACKGROUND OF THE INVENTION

U.S. Pat. No. 5,788,617, entitled "Pectoralis Major and Upper Back Exerciser," issued on Aug. 4, 1998, and is incorporated herein. The invention described therein represented a marked improvement over devices of the past, by providing two-way, spring-less resistance in a hand held exerciser. The exerciser included a joint between two hydraulic arms, each of which had an adjustable valve to permit more or less pneumatic resistance during operation.

While the invention described in the aforementioned patent had several advantages over the prior art, forces exerted by the user could cause damage to the joint between the two arms, particular when using an infinitely adjustable locking mechanism. Moreover, experience indicated that infinite positions of the arms relative to each other, between 0 and 180 degrees, does not provide any advantage that outweighs the disadvantage of having a joint that is too susceptible to weakening through use.

Thus, a need exists for an improved exercise device, for exercising the upper torso, and which is portable for use at home or on the road

SUMMARY OF THE INVENTION

According to one aspect, the present invention comprises an apparatus for exercising the muscles of the body. Preferably, the muscles of the upper torso may be exercised. However, in other aspects any muscle of the body may be exercised including, but not limited to, arm muscles, shoulder muscles, neck muscles, abdominal muscles, back muscles, leg muscles, and the like. According to one aspect, the present invention includes a first arm having a proximal end and a distal end, a second arm having a proximal end and a distal end, and joint means connecting the proximal ends of the first and second arms, for providing limited movement of the first and second arms relative to each other between 0 degrees and 180 degrees.

Preferably, the first and second arms are limited to movement between only four positions: a zero degree orientation, a forty-five degree orientation, a ninety degree orientation, and a one hundred eighty degree orientation. These positions have been determined to be the ideal positions for movement, in terms of maximizing the usefulness of the device for exercising the muscles, and minimizing the complexity and thus cost, of the joint, while providing strong holding power when the joint is in a locked position.

The device is preferably made of two pneumatic cylinders, substantially of the same design and construction as that described in U.S. Pat. No. 5,788,617, which is hereby incorporated by reference. As described in the '617 patent, the arms have adjustable valves to vary the amount of pneumatic pressure and thus resistance to manipulation by the user.

The device is preferably of a size that allows for easy portability, e.g., storage in a suitcase or carry on bag, for easy of inclusion on travel away from home. Also, the device is preferably made of a light weight plastic material, but could also be made of light weight alloys or composite materials.

In a preferred embodiment, the device includes joint means that includes first and second mating, complimentary parts, and the arms include means for imparting fluid resistance to movement by a user. The means for imparting fluid resistance includes first and second rods connected to respective ones of the first and second mating, complimentary parts, first and second cylinders fitting onto respective ones of the first and second rods, wherein an air chamber is formed inside the first and second cylinders. Preferably, valve means, associated with each of the first and second cylinders, control fluid flow in and out of the air chambers, thereby providing means to adjust the resistance offered by each of the first and second arms.

One aspect of the invention is to keep the overall size of the device to one where the device can fit in any relatively portable luggage or baggage. For this purpose, the device includes arms that are between 12 and 18 inches in length.

The joint preferably includes a complementary fastener for holding the two complementary, mating parts of the joint together. The complementary fastener can include a bolt having an enlarged head, and a nut, which is capable of being tightened to fix the first and second arms relative to each other, and of being loosened to adjust the orientation of the first and second arms.

Another aspect of the invention is to provide an exercise device which includes a first arm having proximal and distal ends, a second arm having proximal and distal ends, and a joint connecting the first and second arms to each other at their respective proximal ends. The joint preferably including first and second mating, complementary parts, each having an interface formed with alternating projections and recesses that interfit with each other in a locked position, and a complementary fastener for alternatively separating and fixing the first and second parts in a limited number of desired positions. The limited number of desired positions includes 0, 45, 90 and 180 degrees.

Preferably, the projections and recesses are square teeth having abutting shoulders, and the number of projections and recesses is limited to the number of desired positions. In all embodiments, the first and second arms include means for providing fluid resistance.

The first and second arms includes first and second rods respectively and fixedly connected to the joint, and first and second cylinders respectively and slidably mounted on the first and second rods, and the means for providing fluid resistance includes the first and second rods, the first and second cylinders, and valve means for controlling the amount of air that enters and exits the cylinder during operation of the device.

Another aspect of the present invention is to provide a method of exercising, which includes the steps of providing a device having two reciprocating arms connected to each other at their respective proximal ends, the two reciprocating arms having an angular orientation relative to each other, reciprocating at least one of the two arms, and changing the angular orientation of the two arms relative to each other to one of a 0, 45, 90 and 180 degree orientation.

Preferably, the step of changing the angular orientation of the two arms comprises loosening a complementary fastener, changing the angular orientation to one of 0, 45, 90 and 180 degrees, and tightening the complementary fastener. Moreover, the method further includes changing a resistance to reciprocal motion of the arms by adjusting air pressure within the two arms. The method further includes moving the two arms to a position of 45 degrees relative to each other, adjusting the air pressure to a desired level, and reciprocating the two arms by pushing and pulling the arms in alternating fashion. The method further comprises moving the two arms to a position of 90 degrees relative to each other, adjusting the air pressure to a desired level, and reciprocating the two arms by pushing and pulling the arms in alternating fashion. The method further involves moving the arms to a 180 degree position, thus making the arms in a straight line, so that they can be used to reciprocate both, or one or the other.

BRIEF DESCRIPTION OF THE DRAWINGS

Further features and advantages of the invention can be ascertained from the following detailed description that is provided in connection with the drawings described below.

DETAILED DESCRIPTION OF THE PREFERRED EMBODIMENTS

Figure 1A:
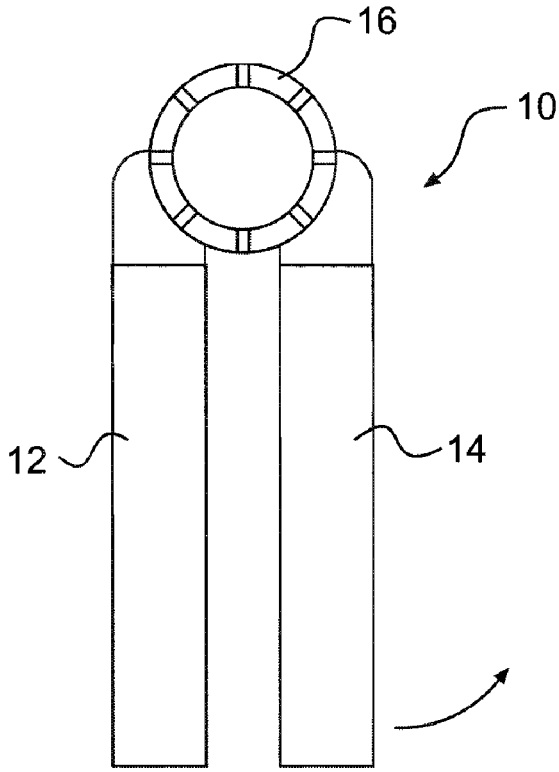
FIGS. 1A through 1D show the device of the present invention in its preferred degrees of orientation.

Referring to FIGS. 1A through 1D, an exercise device 10 includes a first arm 12 having a proximal end and a distal end, a second arm 14 having a proximal end and a distal end, and a joint 16 connecting the two arms 12 and 14 at their proximal ends. Although the operation of the arms is described in detail in the '617 patent, it bears noting that in a preferred embodiment of the invention, each arm comprises a reciprocating cylinder that moves back and forth relative to the joint 16 in response to manipulation by the user. The joint 16 includes pistons (not shown) that are mounted on piston rods. The respective rods are connected to the joint at one end, and carry pistons at the opposite ends. Airflow in and out of the cylinders is regulated by a valve so that as the valves are more closed, there is more resistance, and as the valves are more open, there is less resistance. The amount of resistance is selected by the user depending on his or her strength, or on their desired amount of exercise.

In the orientation shown in FIG. 1A, the two arms 12, and 14 are folded over top of each other in a manner desired for stowage, as for example, in a suit case, brief case, gym bag, or other baggage used for travel. The device can have a variety of sizes, but preferably, the arms are of a length not to exceed 12-24 inches, and preferably, 12-18 inches. Even in the stowed position shown in FIG. 1A, the device 10 can be used to exercise the upper torso muscles of the user by gripping one arm with one hand, and reciprocating the arm with the other hand. This procedure can be reversed so that each arm takes turns being stationary while the other arm reciprocates. A user can emulate "push ups" by having the user lay down on his or her back, affix the joint over head to a fixed structure such as a wall or ceiling or horizontal bar, and then simultaneously push both cylinders in, and then pull them out, to thereby give two-way resistance push ups. If the resistance valves are fully closed, thereby making relative movement between the cylinders and pistons of the arms difficult or impossible, the user can loop the device 10 around a stationary bar or other structure to perform pull ups.

Figure 1B:
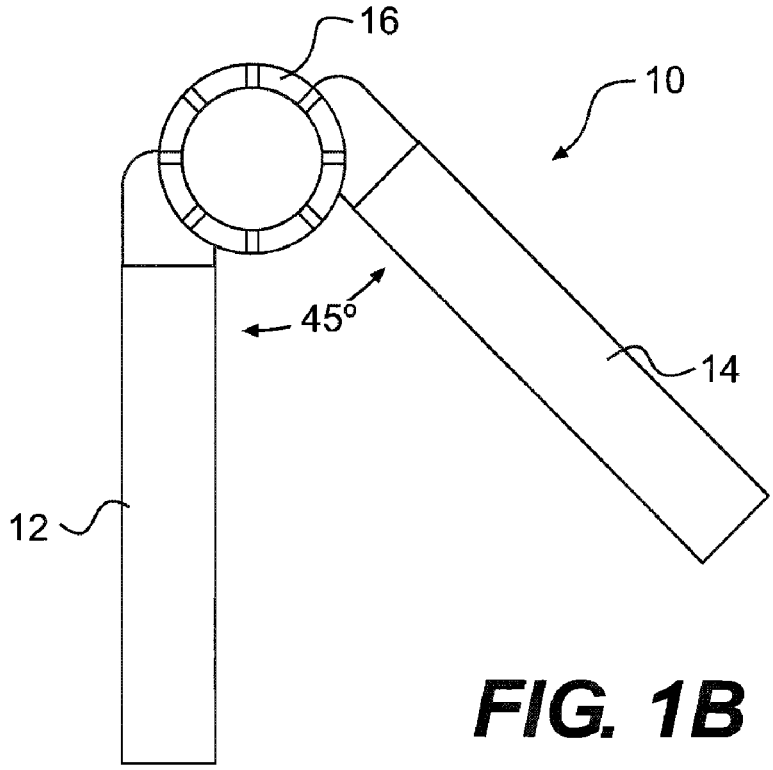

In the orientation of FIG. 1B, the arms 12 and 14 are moved to a position substantially at 45 degrees to one another. In this position, the user can simultaneously move the cylinders of the two arms 12 and 14 in and out for two way resistance. Alternatively, the user can hold one arm stationary, while manipulating the other arm. In any event, the forces on the joint 16 are such that a separation force must be resisted by a joint that has ease of adjustment, but strength in alternative positions.

Figure 1C:
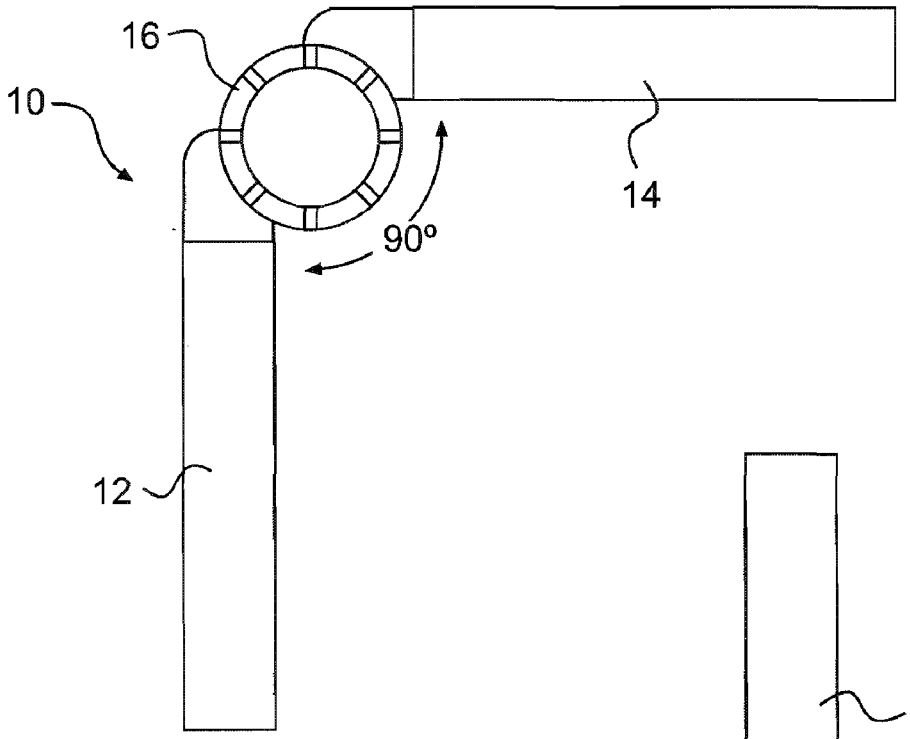

FIG. 1C shows the arms 14 and 16 in 90 degree orientation, such that after the arms are moved into this position, the joint 16 is locked to prevent movement of the arms relative to each other. In this position, both arms 14 and 16 can be manipulated, so that the user is simultaneously moving both arms in and out. Alternatively, one arm can be held stationary while the other arm is pushed and pulled to reciprocate the one arm in and out.

Figure 1D:
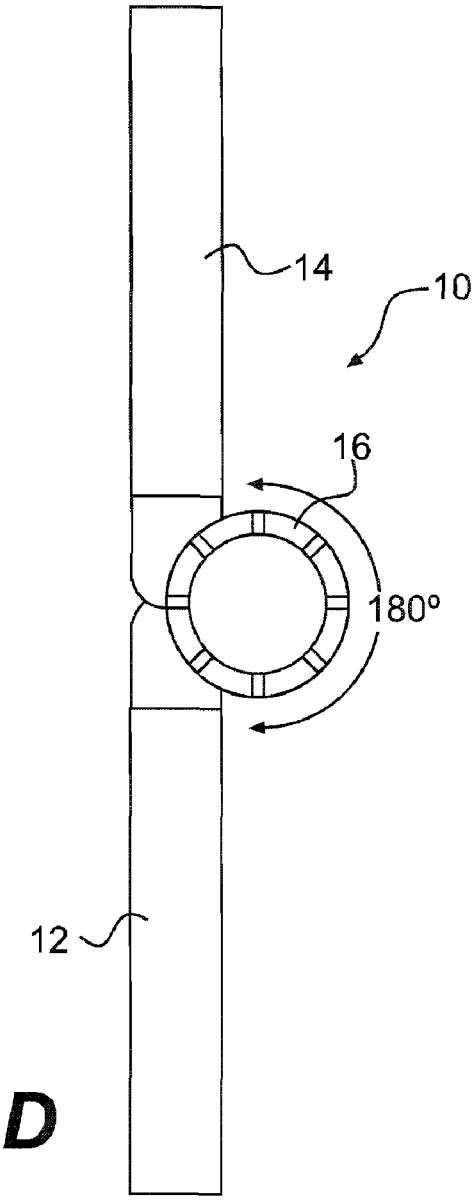

In moving the arms from 45 degrees to 90 degrees, different muscles will be exercised while the device is in use. In FIG. 1D, the arms are moved into a 180 degree orientation and locked so that the user can grab the two arms, with the joint 16 approximately at the sternum, and then the arms are pushed outwardly then pulled inwardly, reciprocating both arms in front of the user. Alternatively, the user can hold one arm stationary, while reciprocating the other arm, then reversing and reciprocating the other arm.

Figure 2:
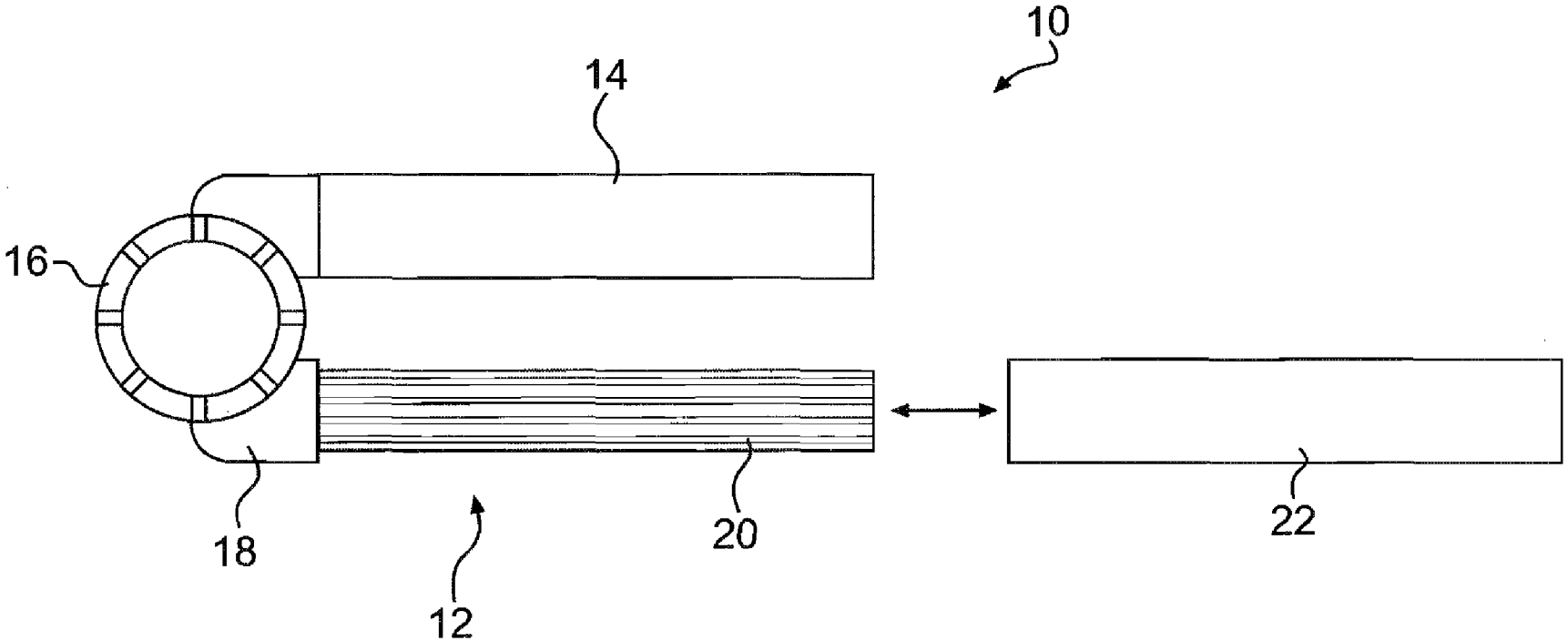
FIG. 2 is an exploded view, showing one of the arms having the cylinder separated from its supporting piston.

Referring now to FIG. 2, arm 12 is shown in simplified, exploded view. The proximal end of the arm 12 includes a base 18 fixedly connected to the joint 16. The base 18 is preferably integrally formed by injection molding with the base 18, and with a rod 20. The rod 20 is preferably fluted or splined as shown, and carries the sleeve or cylinder 22 which is open at both ends. One end slides over the rod 20 and includes abutment or other means to prevent the cylinder 22 from sliding off the rod 20 once assembled. Essentially, the range of reciprocating movement for each cylinder is the length of the cylinder 22, which when assembled, abuts the base 18, as shown in FIG. 2 with respect to the arm 14. Fully extracted, the cylinder 22 extends outwardly the length of the rod 20. Air is brought into and out of the cylinder through a valve (not shown) at the end of the cylinder 22 opposite the base 18. For more detailed understanding of the valve, reference is made to the aforementioned '617 patent.

Figure 3:
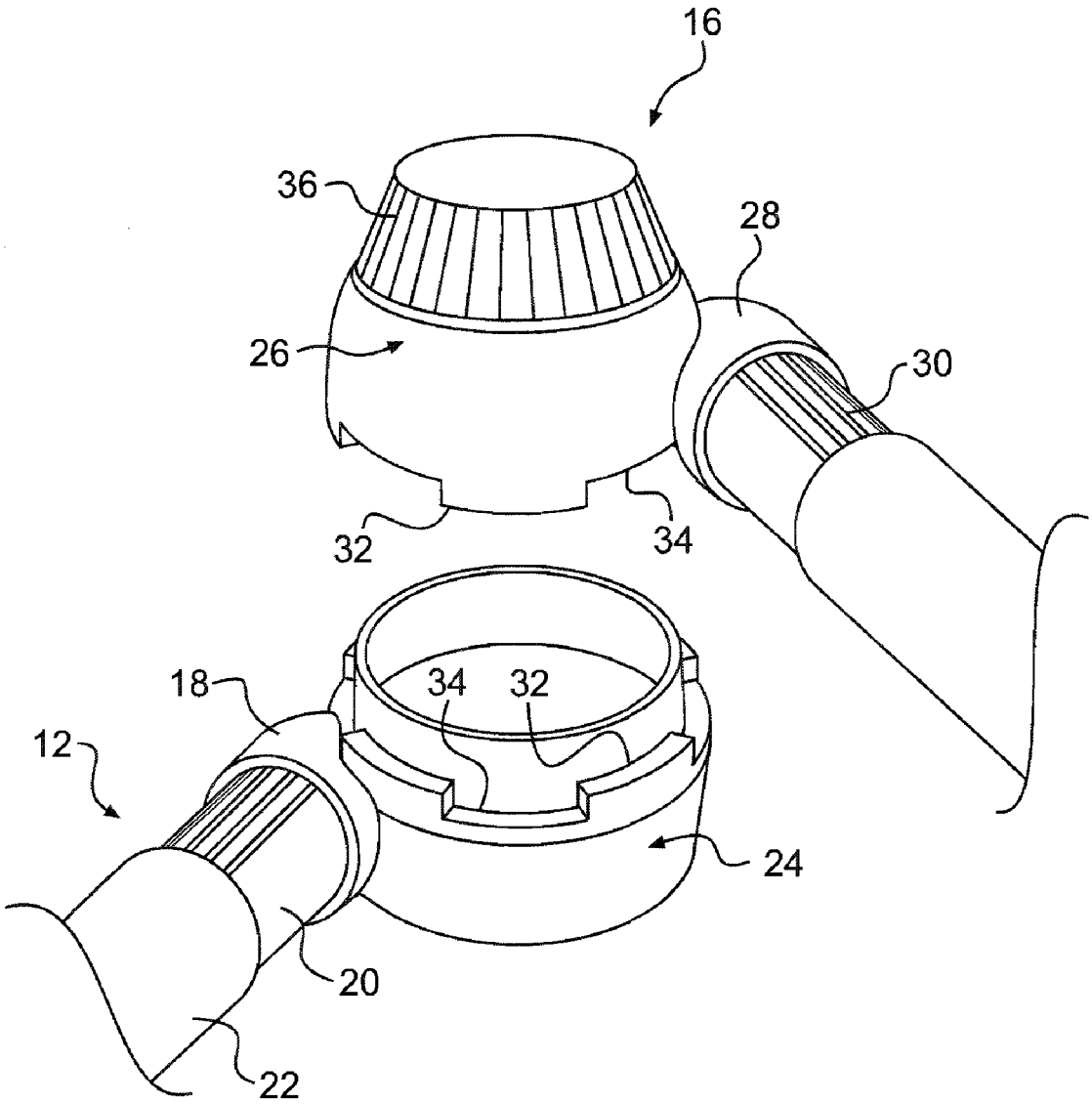
FIG. 3 is an enlarged, partial exploded view showing details of a preferred embodiment of the joint of the present invention.

Referring to FIG. 3, the joint 16 is preferably of a form that includes two cylindrical mating, complimentary parts 24 and 26, each of which supports a base 18, 28 which in turn supports a rod 20, 30. Each part 24 and 26 includes complimentary projections 32 that mate with recesses 34 to lock the arms relative to each other. Any number of means can be employed to hold the two parts together, including nut and bolt, where the nut 36 is enlarged head with gripping formations around the periphery so that the user can screw and unscrew the two parts together. The bolt (not shown) can be fixedly connected to the part 24, projecting upwardly through the inside of the two parts and into a threaded bore provided in the nut 36. Other variations can include that the bolt is fixedly connected to the nut 36, so that the nut is actually the head of the bold, and the threaded end of the bold can threadedly engage a bore provided in the part 24. Any other means can be employed as long as the user can separate the parts without tools or great effort, yet when assembled, the joint locks the arms relative to each other, and resists the forces imparted on the joint by reciprocation of the arms.

The number of projections 32 and recesses 34 is limited because of the limited number of preferred angular orientations of the arms relative to each other. Preferably, the recesses and projections are deep enough so that the shoulders of the recesses are not ground off by repeated use, or do not allow slippage during use.

Preferably the device 10 is made of light weight, hard plastic in order to make the device inexpensive to manufacture, yet strong for repeated use. Other materials can be used, such as composite materials, and even light weight alloyed metals. The outer surface of the cylinders can be provided with a soft rubber sleeve to provide better grip for the user.

Figure 4:
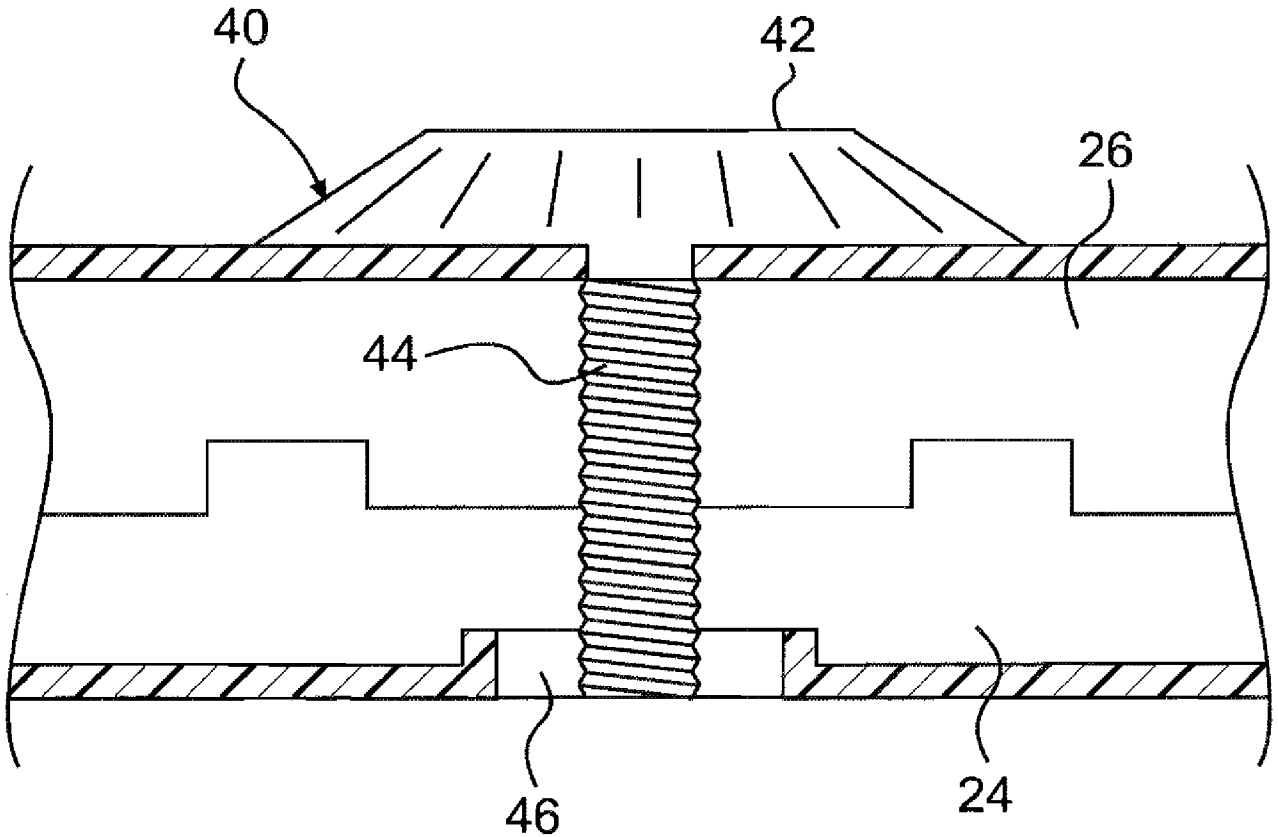
FIG. 4 is an enlarged, cross sectional view showing the joint of the preferred embodiment of the present invention.

FIG. 4 is a cross sectional view showing one example of a locking mechanism, where the two parts 24 and 26 are mated together, with projections mating with recesses. An adjustment screw 40 has an enlarged head 42 and an integrally formed bolt 44 which passes through the interior defined by the mated parts 24 and 26. A nut 46 is fitted into a recess formed in the central region of the part 24. To make an adjustment, the user turns the head 42 counterclockwise until the two parts can be pulled apart. Thereafter, the two parts are moved relative to each other until the recesses and projections are fitted together with the arms being in a desired orientation. For simplicity, there are only enough projections and recesses to allow four positions of the arms: 0, 45, 90 and 180 degrees.

Although the present invention has been described with reference to particular embodiments, it will be understood to those skilled in the art that the invention is capable of a variety of alternative embodiments within the spirit of the appended claims. For example, while the inventive aspects have been described above mainly in conjunction with a locking joint, the invention may also take the form of a joint that uses a spring loaded adjustment mechanism or other means for easily separating the two parts of the joint and reassembling them in a different, but limited number of positions. Moreover, not all disclosed aspects need to be included in any single embodiment. Further, directional references disclosed herein are with respect to the arms relative to each other and are only illustrative in nature.

Finally, although the present invention has been described with respect to exercising the muscles of the upper torso, skilled artisans will recognize that the present invention may be used to exercise any muscles of the body. For instance, in one aspect the present invention may be used to exercise arm, shoulder, leg, torso, back, neck, hand, abdominal, and/or calf muscles.

What is claimed is:

1. An apparatus for exercising the muscles of the upper torso, comprising:

a first arm having a proximal end and a distal end, wherein the proximal end includes a first base fixedly connected to a first mating complementary part that is integrally formed by injection molding with a first fluted rod that is covered by a first sleeve;

a second arm having a proximal end and a distal end, wherein the proximal end includes a second base fixedly connected to a second mating complementary part that is integrally formed by injection molding with a second fluted rod that is covered by a second sleeve;

wherein each of the first and second arms includes means for imparting fluid resistance to movement by a user; and joint means, connecting the proximal ends of the first and second arms, for providing limited movement of the first and second arms relative to each other between 0 degrees and 180 degrees, wherein the joint means includes the first and second mating, complementary parts, each having an interface formed with alternating projections and recesses that interfit with each other in a locked position.

2. The apparatus of claim 1, wherein the first and second arms are limited to movement between only four positions: a zero degree orientation, a forty-five degree orientation, a ninety degree orientation, and a one hundred eighty degree orientation.

3. The apparatus of claim 2, wherein the means for imparting fluid resistance includes first and second rods connected to respective ones of the first and second mating, complimentary parts, first and second cylinders fitting onto respective ones of the first and second rods, wherein an air chamber is formed inside the first and second cylinders.

4. The apparatus of claim 3, further comprising valve means, associated with each of the first and second cylinders, for controlling fluid flow in and out of the air chambers, thereby providing means to adjust the resistance offered by each of the first and second arms.

5. The apparatus of claim 1, wherein the arms are between 12 and 18 inches in length.

6. The apparatus of claim 2, wherein the joint means further comprises a complementary fastener for holding the two complementary, mating parts together.

7. The apparatus of claim 6, wherein the complementary fastener means includes a bolt having an enlarged head, and a nut, which is capable of being tightened to fix the first and second arms relative to each other, and of being loosened to adjust the orientation of the first and second arms.

8. An exercise device comprising:

a first arm having proximal and distal ends, wherein the proximal end includes a first base fixedly connected to a first mating complementary part that is integrally formed by injection molding with a first fluted rod that is covered by a first sleeve;

a second arm having proximal and distal ends, wherein the proximal end includes a second base fixedly connected to a second mating complementary part that is integrally formed by injection molding with a second fluted rod that is covered by a second sleeve;

wherein the first and second arms include means for providing fluid resistance; and a joint connecting the first and second arms to each other at their respective proximal ends, the joint including the first and second mating, complementary parts, each having an interface formed with alternating projections and recesses that interfit with each other in a locked position, and a complementary fastener for alternatively separating and fixing the first and second parts in a limited number of desired positions.

9. The exercise device of claim 8, wherein the limited number of desired positions includes 0, 45, 90 and 180 degrees.

10. The exercise device of claim 9, wherein the projections and recesses are square teeth having abutting shoulders.

11. The exercise device of claim 10, wherein the number of projections and recesses is limited to the number of desired positions.

12. The exercise device of claim 11, wherein each of the first and second arms includes first and second rods respectively and fixedly connected to the joint, and first and second cylinders respectively and slidably mounted on the first and second rods, and the means for providing fluid resistance includes the first and second rods, the first and second cylinders, and valve means for controlling the amount of air that enters and exits the cylinder during operation of the device.

13. A method of exercising, comprising:

providing a device having two reciprocating arms connected to each other at their respective proximal ends, the two reciprocating arms having an angular orientation relative to each other;

reciprocating at least one of the two arms; and changing the angular orientation of the two arms relative to each other to one of a 0, 45, 90 and 180 degree orientation, wherein each proximal end includes a base fixedly connected to a complementary part that is integrally formed by injection molding with a fluted rod that is covered by a sleeve.

14. The method of claim 13, wherein the step of changing the angular orientation of the two arms comprises loosening a complementary fastener, changing the angular orientation to one of 0, 45, 90 and 180 degrees, and tightening the complementary fastener.

15. The method of claim 14, further comprising changing a resistance to reciprocal motion of the arms by adjusting air pressure within the two arms.

16. The method of claim 14, further comprising moving the two arms to a position of 45 degrees relative to each other, adjusting the air pressure to a desired level, and reciprocating the two arms by pushing and pulling the arms in alternating fashion.

17. The method of claim 14, further comprising moving the two arms to a position of 90 degrees relative to each other, adjusting the air pressure to a desired level, and reciprocating the two arms by pushing and pulling the arms in alternating fashion.

* * * * *